US006959707B2

(12) United States Patent
Fujiwara

(10) Patent No.: US 6,959,707 B2
(45) Date of Patent: Nov. 1, 2005

(54) GAS COMBUSTION TYPE HAIR DRIER

(75) Inventor: Akinobu Fujiwara, Yamanashi (JP)

(73) Assignee: Re-Tec Inc., Yamanashi (JP)

( * ) Notice: Subject to any disclaimer, the term of this patent is extended or adjusted under 35 U.S.C. 154(b) by 0 days.

(21) Appl. No.: 10/467,573

(22) PCT Filed: Dec. 28, 2001

(86) PCT No.: PCT/JP01/11643

§ 371 (c)(1),
(2), (4) Date: Dec. 22, 2003

(87) PCT Pub. No.: WO02/063990

PCT Pub. Date: Aug. 22, 2002

(65) Prior Publication Data

US 2004/0078992 A1 Apr. 29, 2004

(30) Foreign Application Priority Data

Feb. 9, 2001 (JP) ..... 2001-033839

(51) Int. Cl.[7] ..... F24H 3/04; A45D 20/06

(52) U.S. Cl. ..... 126/401; 431/344; 431/254; 34/97

(58) Field of Search ..... 126/401, 409; 34/96, 97, 98; 431/344, 258, 255, 254, 170; 432/222

(56) References Cited

U.S. PATENT DOCUMENTS 4,726,767 A 2/1988 Nakajima
4,757,183 A * 7/1988 Karey et al. ..... 34/97
4,800,654 A 1/1989 Levin et al.
5,009,592 A 4/1991 Roldan et al.
5,403,184 A * 4/1995 Hosaka et al. ..... 126/401
5,996,243 A * 12/1999 Chang et al. ..... 34/97

FOREIGN PATENT DOCUMENTS

JP 3-236802 A * 10/1991 ..... A45D/20/06
JP 2000-266409 9/2000

* cited by examiner

*Primary Examiner*—Josiah C. Cocks
(74) *Attorney, Agent, or Firm*—Brenda O. Holmes; Kilpatrick Stockton LLP

(57) ABSTRACT

A gas combustion type hair drier 1 includes a gas tank 29, for storing combustion gas, a combustor 11 for combusting combustion gas supplied from the gas tank 29, a blower 17 exchanging heat resulting from the combustor 11, a dry battery 31 serving as a power supply to rotate a motor 19 of the blower 17, an igniter device for igniting the combustion gas, an ejector 7 for allowing outside air to be drawn due to negative pressure created by a flow speed of the combustion gas to be supplied to the combustor 11, and a casing 3 that receives the combustor 11, the blower 17 and the ejector 7, with the combustor 11 having a plurality of combustion chambers 85 comprised of non-circular outer peripheral walls around a periphery of a gas combustor section 73.

10 Claims, 5 Drawing Sheets

GAS COMBUSTION TYPE HAIR DRIER

CROSS-REFERENCE TO RELATED APPLICATION

This application claims the benefit of International Application No. PCT/JP01/11643 filed Dec. 28, 2001.

TECHNICAL FIELD

The present invention relates to gas combustion type hair driers and, more particularly, to a combustion type cordless hair drier that uses a combustion flame, resulting from liquefied petroleum gas (hereinafter referred to as LPG), as a heat source and, further, that is comprised of a battery and a blower to be available for a portable use.

BACKGROUND ART

A technology which has been studied by the present inventor is shown in FIGS. 1 and 2. A hair drier 101, devised for a portable use to utilize LPG, is comprised of a premixing chamber 105 disposed inside a cylindrical case 103 to allow LPG and air to be mixed, a combustion dish 107 composed of a porous combustion plate that blows out mixed gas obtained in the premixing camber 105, and an ignition plug 109 that ignites mixed gas ejected from the combustion dish 107 while including a primary combustion chamber 111 serving as a combustion cylinder to combust the above described mixed gas, a secondary combustion chamber 115 that performs nonflammable combustion through a combustion catalyst 113 in a forward area of the primary combustion chamber 111, and a heat exchanger 117 composed of a star shaped peripheral wall formed between peripheries of the above described primary combustion chamber 111 and the secondary combustion chamber 115 and the cylindrical case 103.

Also, disposed in a rear side wall of the premixing chamber 105 is a plurality of air apertures 119 to introduce outside air, and use is made of ceramics such as porous cordierite series and porous alumina as raw materials to generally serve as a carrier body of the combustor catalyst 113.

Further, disposed in the rear end wall of the premixing chamber 105 is a blower 125 that is comprised of a direct electric motor 121 mounted on a rearward area of the above premixing chamber 105, and an axial flow fan 123 adapted to be rotationally driven by the direct electric motor 121 to allow air, required for combustion in the cylindrical case 103 and a large volume of hot blast to be delivered.

The LPG tank, for storing LPG, to be supplied to the above described premixing chamber 105, and the battery (mainly a primary battery), serving as the power supply of the ignition plug 109, are accommodated in a handle, which is not shown, connected to the above described cylindrical case 103.

By the way, with the combustion type hair drier 101 of the related art, since air required for combustion of LPG is drawn through the plurality of air apertures 119 partly from a volume of blast delivered by the blower 125 needed to generate a large volume of hot blast, the occurrence of drop in the voltage of the battery, to cause drop in the above described volume of blast, results in short of air in volume to be required for combustion of LPG. As a result, a probability occurs in which mixed gas with oxygen deficiency arriving at the outlet 127 (exhaust port) is brought into contact with air at the outlet 127 followed by a resultant flame to cause combustion.

Moreover, it was found out that, without using the combustion catalyst 113 of FIG. 1, if the primary combustion chamber 111 is improved to allow combustion to internally occur in the cylinder, the combustion flame advances along the cylinder to the outlet 127 (exhaust port) and, hence, it was hard to effectuate combustion to obtain a minimal volume of heat required for the hair drier 101 unless a remarkably long cylinder or a combustion cylinder with a large diameter are employed. In this respect, the minimal volume of heat refers to a value of, for instance, a heat output of 450 W/H under a combustion condition of LPG with a value of approximately 390 Kcal/H. Consequently, the combustion type hair drier 101 of the related art takes the size two times the normal electric type hair drier and, with such a dimension, there occurs an issue of a practicability as a portable unit.

Further, as a method for efficiently achieving combustion without occurrence of the flame, although development work has been undertaken to utilize the combustion catalyst 113 as shown in FIG. 1 set forth above, due to the presence of this case suffered from a resultant heat accumulated in the center of the combustion catalyst 113 while, also, exchange of heat with blast is performed only through the heat exchanger 117 around the combustion catalyst 113, no probability occurs in exchange of heat accumulated in the center of the combustion catalyst 113 at which the maximum temperature rise occurs and experimental tests have revealed a result with a remarkably poor efficiency.

Moreover, due the presence of the surface area of the outlet 127 resulting from the heat exchanger 117 in an actual practice to lie in a less surface area, a pressure loss in blast takes place, causing an issue of reduction in a volume of blast.

In addition, a serious issue arising in the systems in the former and the latter set forth above suffers from an inability of achieving rapid cooling at the combusted portion even after the supply of LPG has stopped when in non-use and, therefore, it is probable for a fairly high temperature remains for a long period of time. Especially, even after an elapse of twenty minutes, it is hard for a hand to touch the unit in which the combustion catalyst 113 is utilized.

Also, although another improvement has been proposed to automatically operate the blower 125 for the purpose of cooling a condition in which, even after the use of the hair drier 101 has been terminated, the high temperature remains, an issue arises in that the portable unit, needed for standby between the end of use of the hair drier 101 and the end of cooling, becomes inconvenient and incommodious in use.

Further, even with the portable type cordless unit, it is required for a working condition, needed to a minimal extent, of the hair drier 101 to have a heat value of 450 W/H, converted in electric power, with a combustion energy of approximately 390 Kcal/H. Also, because of the portable type hair drier 101, it is required to have a size and weight which do not exceed those of the commercially available electric type hair drier in the related art practice.

DISCLOSURE OF INVENTION

This invention has been made to address the issues set forth above and has an object to provide a combustion type hair drier which enables a combustion efficiency and a heat exchange rate to be improved so as not to allow a combustion flame, serving as a heat source, resulting from LPG to eject outward while enabling reduction in pressure loss in blast.

To achieve the above object, a first aspect of a gas combustion type hair drier comprises a gas tank for storing combustion gas therein, a combustor section for combusting combustion gas supplied from the gas tank, a cylindrical combustor having the combustor section, a blower for exchanging heat resulting from the combustor, a power supply for rotating a motor of the blower, an igniter for igniting the combustion gas, an ejector for drawing outside air resulting from negative pressure caused by a flow speed of combustion gas supplied to the combustor, and a casing in which the combustor, the blower and the ejector are accommodated, wherein the combustor further has a plurality of combustion chambers composed of non-circular outer peripheral walls formed around a periphery of the combustor section.

Further, the outer peripheral walls may have recessed configurations extending in radial directions.

Accordingly, due to the occurrence of negative pressure created in the ejector by an ejector effect due to an ejection speed of combustion gas, atmospheric air required for combustion is drawn to flow in. Air required for combustion is automatically drawn in proportion to an increase and a decrease of combustion gas and, even if voltage drop occurs in the battery, no probability occurs in incomplete combustion.

And, since the combustion flame is created from the gas combustion section at the center portion of the combustor toward the plurality of combustion chambers formed in recessed shapes in radial direction to form a petal in a thin and uniform manner, heat values resulting from the respective combustion chambers are efficiently transferred to the air stream delivered from the blower to provide an increased heat exchange rate.

A second aspect of a gas combustion type hair drier of the present invention, related to the combustion type hair drier of the first aspect, has air intake portions of the ejector around which an intake air stabilizing member is disposed so as to prevent an air stream from being influenced to be unstable condition resulting from blast delivered from the blower to thereby achieve stabilization of intake air.

Further, the intake air stabilizing member may be composed of porous raw material such as wire gauze, sintered metal, porous ceramic and porous plastic.

Accordingly, since the intake air stabilizing member is disposed at the intake air port area, the air stream is prevented from being influenced from the unstable condition caused by blast delivered from the blower.

And, while the porous raw material is low in cost and simple but plays a roll to achieve an effective work as a rectifying action of the air stream, there is an effect of protecting a disturbance from occurring at the intake air port area.

In a third aspect of a gas combustion type hair drier of the present invention, related to the combustion type hair drier of the first aspect, the combustor is located between the blower and an outlet of the casing while an outer peripheral wall of the combustor has a portion to be partially held in contact with an inner wall of the casing, and air flow passage portions are defined between an outer peripheral wall of the combustor and an inner peripheral wall of the casing.

Accordingly, the air flow passages defined between the outer peripheral wall of the combustor and the inner peripheral wall of the casing enables the heat value of the combustor to be efficiently transferred to the air stream delivered from the blower through the outer peripheral surface of the combustor to increase the heat exchange rate, resulting in reduction in pressure loss.

In a fourth aspect of a gas combustion type hair drier of the present invention, related to the combustion type hair drier of the first aspect, the gas combustor section includes a gas straight blow limiter segment disposed at an ejecting portion of the combustion gas within the combustor to prevent the combustion gas from directly advancing while promoting to combustion gas to flow out in a radial direction.

As a consequence, since the gas combustor section is provided with gas straight blow limiter segment disposed at the ejecting portion of the gas combustor, the combustion flame is created from the gas combustor section at the center portion of the combustor in the radial directions in a thin and uniform manner, thereby precluding a flame from occurring at the exhaust port of the combustor.

Although design is made in a way to limit combustion gas with a view to avoiding occurrence of accident wherein, when a probability occurs in a deficiency such as an abnormal increase in gas for combustion, the flame comes out from the outlet for the hot blast, even when the deficiency occurs by any chance to cause combustion gas to eject in a volume more than required, a large volume of air flowing through the peripheries of the combustion chambers by the action of the blower is mixed with combustion gas immediately in front of the outlet, no probability occurs for the flame to go to the outside (wherein excessive air is unable to maintain a flame combustion and the flame is distinguished).

In a fifth aspect of a gas combustion type hair drier of the present invention, related to the combustion type hair drier of the first aspect, a combustion catalyst is disposed in the outlet portion of the combustor.

Consequently, since the combustion catalyst has a effect of distinguishing the flame to be nonflammable, it becomes possible to reliably preclude the occurrence of the flame resulting from the exhaust port of the combustor.

In a sixth aspect of a gas combustion type hair drier of the present invention, related to the combustion type hair drier of the first aspect, the gas combustion gas includes LPG.

Accordingly, since LPG combusts followed by occurrence of a large volume of warm steam, the hot blast with the large volume of steam does not give damages to the hairs with a favorable influence thereon.

In a seventh aspect of a gas combustion type hair drier of the present invention, related to the combustion type hair drier of the first aspect, the ejector further includes the combustion gas storage chamber, a mixed gas generating chamber, and a filter disposed between the combustion gas storage chamber and the mixed gas generating chamber to remove impurities and dusts from the combustion gas.

Accordingly, it is possible to create mixed gas with a high purity.

BEST MODE FOR CARRYING OUT THE INVENTION

Hereinafter, a detail description is made of a gas combustion type hair drier of an embodiment according to the present invention with reference to the accompanying drawings.

Figure 1:
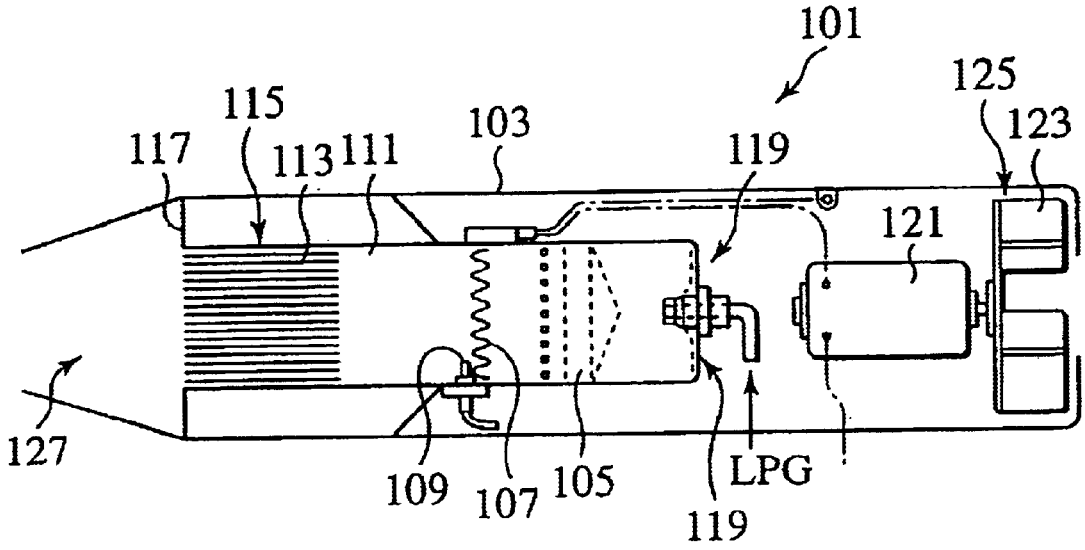
FIG.1 PRIOR ART
FIG. 1 is a partial longitudinal cross sectional view of a combustion type hair drier to which study has been undertaken by the inventor.
Figure 2:
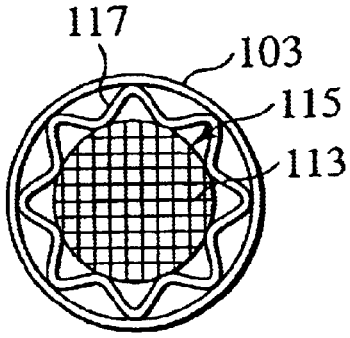
FIG.2 PRIOR ART
FIG. 2 is a left side view of FIG. 1.
Figure 3:
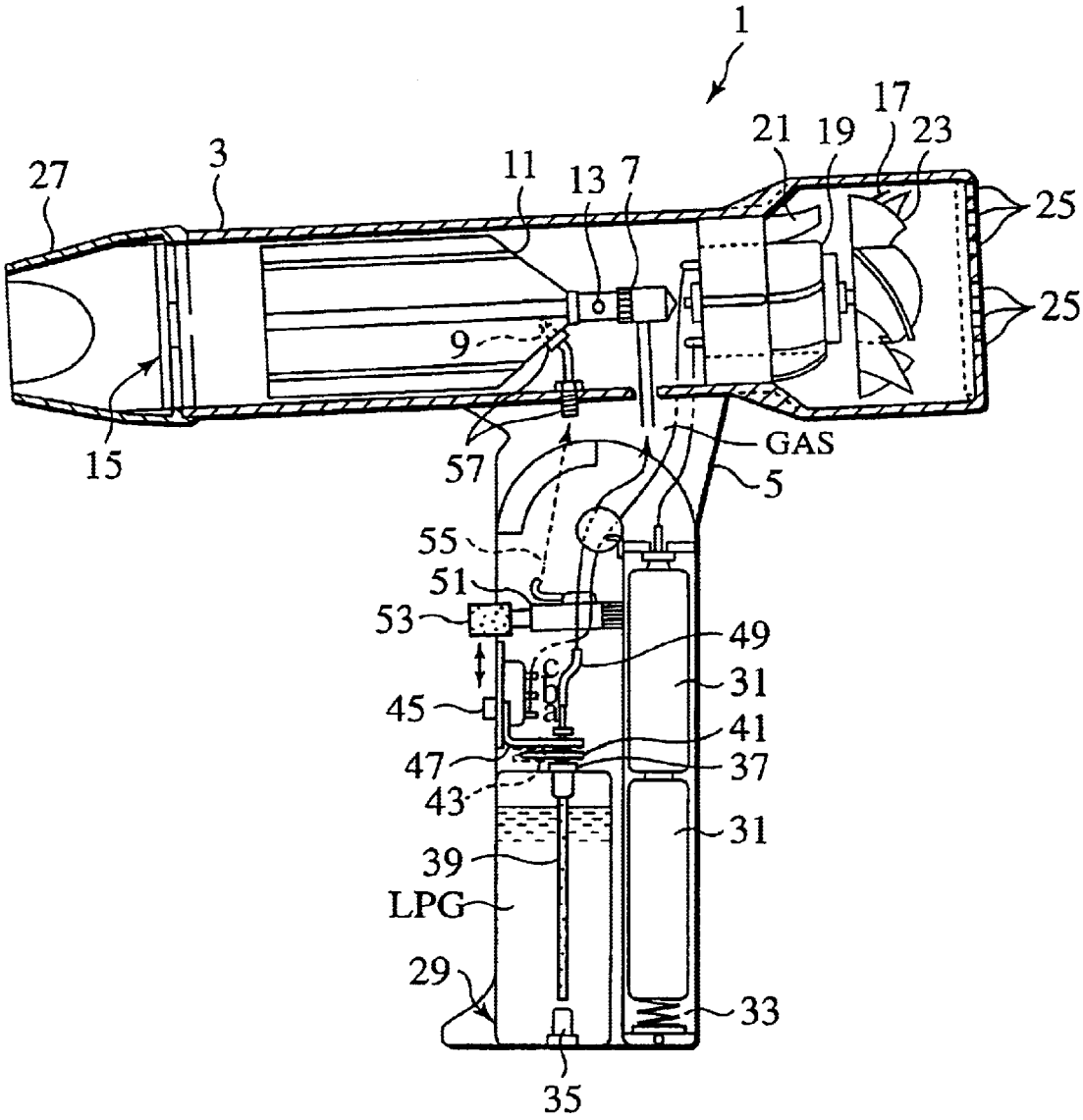
FIG. 3 shows an embodiment of the present invention and is a longitudinal cross sectional view of a combustion type hair drier.

Referring to FIG. 3, a hair drier 1 of the presently filed embodiment includes a casing 3 in a cylindrical shape that takes the form of a cylindrical tubular configuration made of stainless steel in the presently filed embodiment, and disposed on a side wall of the casing 3 is a handle section 5 made of a plastic case elongated in a direction substantially intersecting a longitudinal direction of the casing 3.

Internally received in the casing 3 are an ejector 7 to allow fuel, such as LPG, and air to be mixed with one another to form mixed gas as combustion gas, an ignition device such as an ignition plug 9 for igniting mixed gas resulting from the ejector 7, and a combustor 11 that allows mixed gas, ignited with the ignition plug 9, to be combusted. Also formed in the ejector 7 are air intake ports 13 that draw air to be introduced into an interior of the ejector 7.

Further, internally mounted in the casing 3 is a blower 17 which is located rearward (rightward in FIG. 3) of the ejector 7 to allow air, heated by the combustor 11, to be delivered to an outlet 15 of the casing 7. As the blower 17, a direct electric motor 19 is installed on an inner wall surface of the casing at a rear side thereof by means of a bracket 21 formed with an air flow passage, and an axial flow fan 23 is fixedly mounted on a rotor shaft of the direct electric motor 19.

Also, a rear end of the casing 3 is covered with a wall surface formed with a large number of apertures 25 for drawing air for the sake of safety, and detachably mounted to a forward end (rightmost end in FIG. 3) of the casing 3 is a nozzle 27 serving as an outlet for hot blast.

Internally mounted in the handle section 5 are a gas tank 29 that accumulates fuel gas, such as LPG, to supply fuel gas to the ejector 7, and a dry battery case 33 that allows a power supply, such as two pieces of dry batteries 31, to be detachably received therein to activate the direct electric motor 19 of the blower 17.

Moreover, disposed at a bottom wall of the handle section 5 is a charge valve 35, that enable LPG to be replenished, which in turn communicates with a lower end of the gas tank 29. Disposed on an upper end surface of the gas tank 29 is a crater valve 37, to which a suction core 39 for LPG is mounted and extends inside the gas tank 29. Additionally, disposed on the crater valve 37 is a gas control knob 41, adapted to adjust a combustion gas closure state, that protrudes outward from a bore portion 43 formed in a side wall of the handle section 5.

Further, disposed on the side wall (left side surface in FIG. 3) of the handle section 5 is a switch 45 that functions to allow a power switch of the blower 17 and gas closure of the crater valve 37 to be turned on or turned off in an interlocking manner, with the switch 45 being constructed to be interlocked with a closure lever 47 that switches over ON/OFF statuses of gas closure of the crater valve 37. Moreover, in the presently filed embodiment, the switch 45 is structured to be adjustable in three stages involving, for instance, a stage a in which both the power supply and the crater valve 37 are turned off, a stage b in which the power supply is turned on whereas the crater valve 37 is turned off to allow only cold blast to be generated, and a stage c in which both the power supply and the crater valve 37 are turned on to allow hot blast to be generated.

Also, the crater valve 37 is in communication with a gas flow passage, such as a gas supply pipe 49 for the purpose of supplying LPG to the ejector 7.

Furthermore, incorporated in the handle section 5 is an ignition piezoelectric element 51, forming a part of an ignition device, to which an ignition knob 53 for generating a high electricity is connected and protrudes outside from the side wall of the handle section 5. The piezoelectric element 51 is connected to the ignition plug 9 by means of a wiring 55 extending through an insulator 57.

Figure 4:
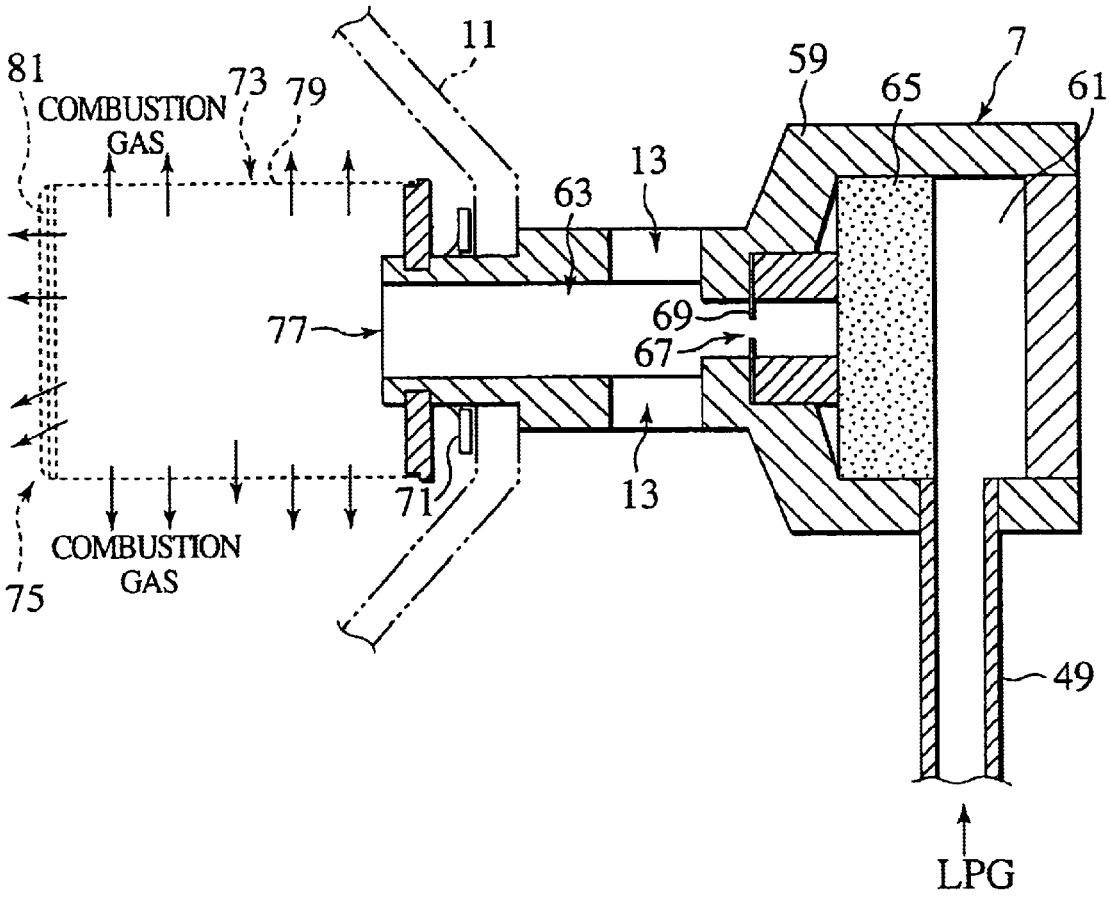
FIG. 4 is an enlarged side view of a vicinity of an ejector of the embodiment of the present invention.

Referring also to FIG. 4, to describe the ejector more in detail, disposed in the ejector 7 are an LPG storage chamber 61 that stores LPG supplied from the gas tank 29 through the gas supply pipe 49, and a mixed gas generating chamber 63 that allows LPG and air to be mixed to produce mixed gas to be introduced to the combustor 11, with the air intake ports 13 extending through the side wall of the mixed gas generating chamber 63.

Moreover, disposed between the LPG storage chamber 61 and the mixed gas generating chamber 63 is a filter 63 by which impurities and dusts are removed form LPG, and an orifice 67 that allows LPG, which has passed through the filter 65, to be ejected at a high speed closer to an acoustic velocity. Formed at a substantially center of a pin-hole disc 69 in a circular plate shape is a pin-hole with a diameter of 100 ì m serving as the orifice 67. Also, use is made of sintered metal, as the filter 65, that has a pin-hole with a diameter of, for instance, 10 to 30 ì m.

Further, a forward end of an ejector body 59 serves as an ejector portion of combustion gas (mixed gas) to be delivered to the combustor 11 and protrudes into an interior of a rear end of the combustor 11 whereupon it is mounted to a stopper 71 to allow a forward end of the ejector body 59 to support a gas combustor section 73 such that it extends to the interior of the combustor 11. Disposed in the gas combustion combustor section 73 is a direct advance limiter segment 75 that limits direct advance of combustion gas resulting from mixed gas, upon ignition and combustion thereof, delivered from the mixed gas generating chamber 63 to promote flow of combustion gas mainly in a radial, sidewise direction.

The direct advance limiter segment 75 is formed of, for instance, a stainless wire gauze formed in a cylindrical cage with 40 to 60 meshes in a way to surround a periphery of a gas ejector port 77 that allows mixed gas delivered from the mixed gas generating chamber 63 to eject, and further overlapped over the wire gauze 79 of 40 to 60 meshes at a forward end surface of the cylindrical cage is a stainless steel wire gauze 81 with 80 to 120 meshes.

Figure 5:
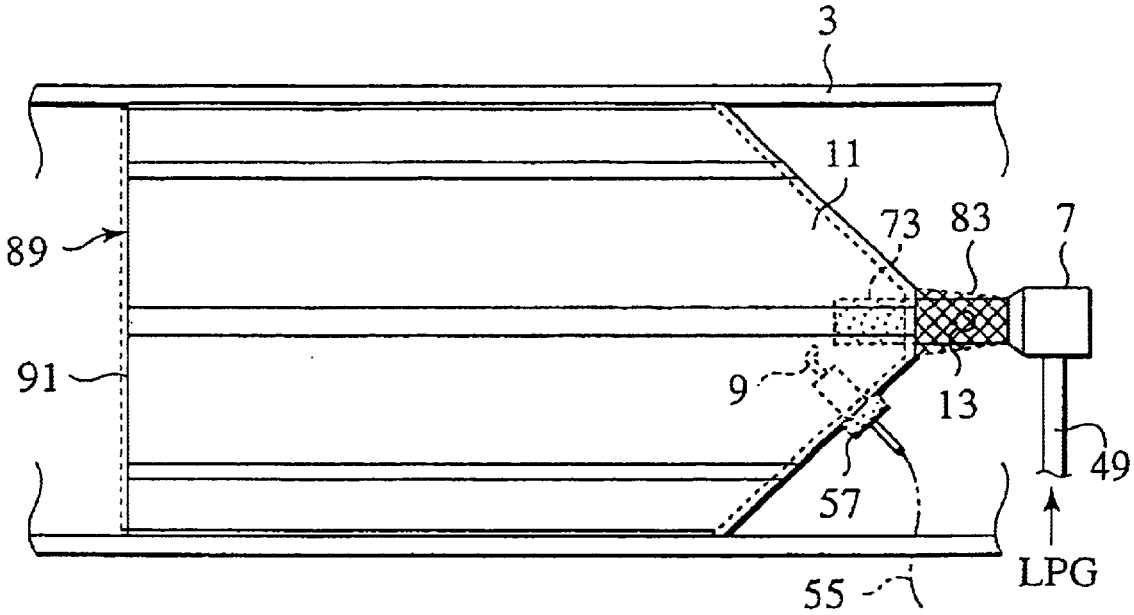
FIG. 5 is an enlarged side view of a combustor of the embodiment of present invention.

Referring further to FIG. 5, the ignition plug 9 is installed inside the combustor 11 at a position in close proximity to the forward end of the gas combustor section 73.

Further, a peripheral area of the air intake ports 13 of the ejector 7 is constructed so as to be covered with, for instance, a stainless steel wire gauze 83 that serve as an intake air stabilizer member to prevent air flow from being unstable caused by resulting blast from the blower 17 while achieving stabilized intake of air.

Figure 6:
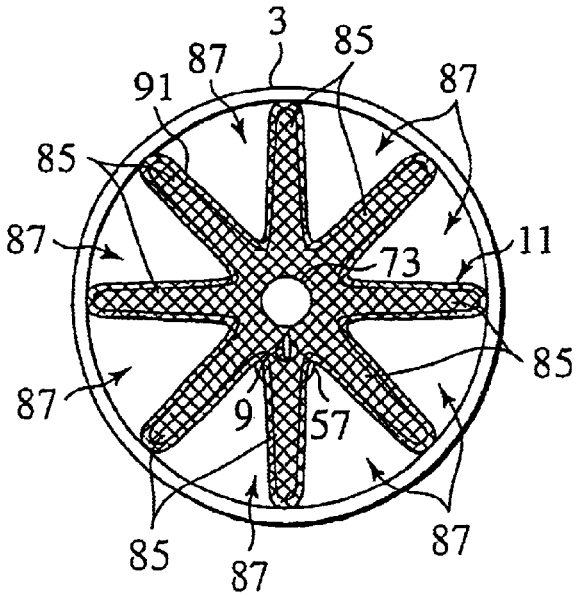
FIG. 6 is a left side view of FIG. 5.

The combustor 11 is located between the blower 17 and the outlet 15 of the casing 3, as shown in FIG. 3, and, in the presently filed embodiment, is constructed of a non-circular cylindrical body having a central area in which the gas combustor section 73 is located in a cross sectional configuration intersecting a longitudinal axis of the combustor 11, as viewed in FIG. 6, and eight recess-shaped combustion chambers 85 extending in radial directions in eight-split star-projecting configurations formed around the combustor section 73. Also, the combustor 11 may preferably be made from thin plate material, formed of copper and aluminum that have favorable heat conductivity, with a thickness of 0.2 to 0.5 mm.

More particularly, as shown in FIG. 6, the combustor 11 includes the non-circular cylindrical body that is constructed such that outer peripheral surfaces of distal end portions of the eight-split star projections of the combustor 11 are held in contact with an inner surface of the casing 3 and air flow passages 87 are formed between outer peripheral surfaces of the combustor 11, except for the distal end portions of the eight-split star projections, and the inner peripheral surface of the casing 3.

Further, although the star projections may have 6 to 12-split shapes, the presence of a less number of splits reduces a heat exchange rate whereas the presence of an excessively large number of splits increases a pressure loss and, hence, in order to obtain a result in a high heat exchange rate and pressure loss, it is preferable for the star projections to be formed in the eight-split configurations.

Furthermore, mounted on an exhaust port 89 of a forward end of the combustor 11 is a wire gauze 91 with 20 to 60 meshes made of copper or copper alloy having a high heat conductivity.

Figure 7:
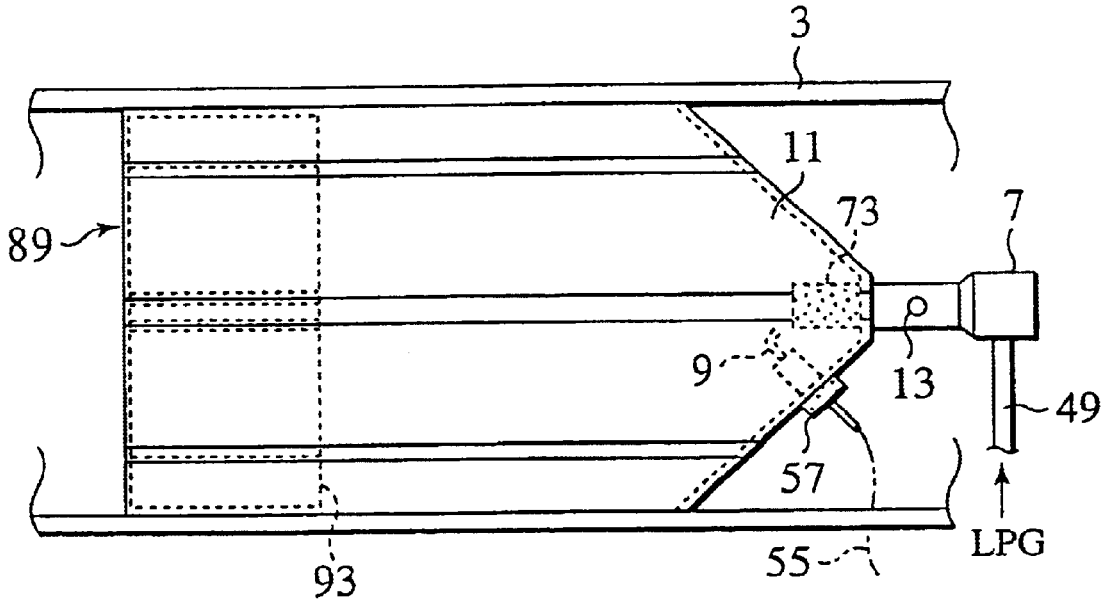
FIG. 7 is an enlarged side view of a combustor of another embodiment of the present invention.
Figure 8:
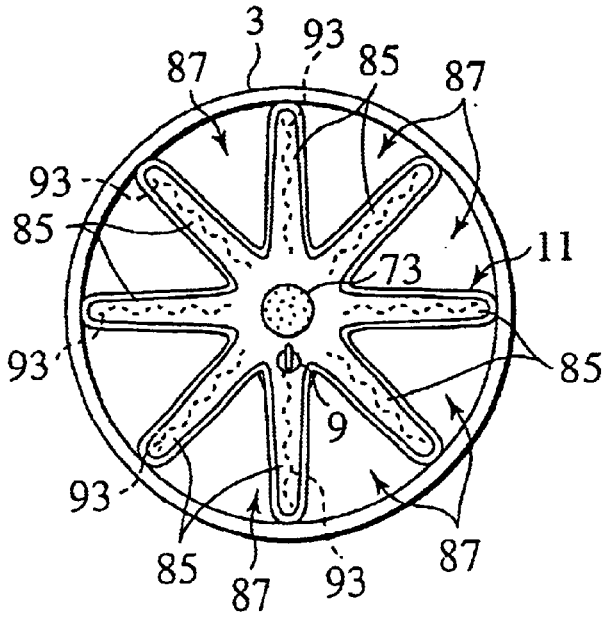
FIG. 8 is a left side view of FIG. 7.

In FIGS. 7 and 8, a combustor 11 of another embodiment is shown in the substantially same structure as those of FIGS. 5 and 6 set forth above except in that combustor catalysts 93 are disposed in the outlet portion of the combustor 11, i.e., for instance, in areas of approximately one third of exhaust areas of the respective combustion chambers 85. For instance, each combustor catalyst 93 includes a carrier body, that is made from a mesh configuration or a porous plate formed by punching, and is disposed in each combustion chambers 85. Other structures of the combustor 11 are identical to those of FIGS. 5 and 6 and, therefore, detailed description of the same is herein omitted.

With such a structure set forth above, occurrence of a flame resulting from the exhaust port 89 of the combustor 11 is reliably protected. The hair drier 1 is a unit to be used by a human body and, therefore, occurrence of the flame from the outlet 15 of the casing by any chance is not acceptable. In this respect, the combustion catalysts 93 are advantageous in extinguishing the flame to provide a nonflammable capability.

The hair drier 1 fabricated as a prototype on the basis of the embodiments above described above had the gas tank 29 with a capacity of approximately 28 ml filled with LPG mixture gas mainly composed of butane while two sets of alcaline batteries LR-6 are set as the dry batteries 31 forming the power supply, and demonstration test was conducted. In this instance, a battery life was approximately two hours in a continuous use, and LPG continued for about twenty minutes at a rate of 390 kcal/H in a continuous use. The above dry batteries 31 could be replaced, and LPG could be charged through the charge valve 35 any time from a commercially available small sized bomb.

A description is made of how the hair drier operates in conjunction with FIG. 3. First, the switch 45 is raised one step from the stage a to the stage b, at which the axial flow fan 23 directly connected to the direct motor 19 begins to rotate to commence delivery of blast. Then, if the switch 45 is further raised two steps to the stage c, the closure lever 47 for gas is elevated to allow LPG in the gas tank 29 to be supplied to the LPG storage chamber 61 of the ejector 7.

Turning to FIG. 4, LPG in the LPG storage chamber 61 of the ejector 7 elevates at a pressure of approximately 1.8 to 2.0 kg/cm$^2$ and passes through the filter 65 from the LPG storage chamber 61 whereupon LPG is ejected from the orifice 67 into the mixed gas generating chamber 63 at the speed closer to the acoustic sound. This results in creation of negative pressure, resulting from an ejector effect, in the mixed gas generating chamber 63 whereby air (in compliance with an air-fuel ratio) required for combustion is drawn from the air intake ports 13 to flow into the mixed gas generating chamber 63, with an air stream and LPG stream are mixed to one another to form mixed gas which in turn is ejected from the gas ejection port 77, disposed at the forward area, into the gas combustion chamber 73.

Accordingly, since air is automatically drawn into the mixed gas generating chamber 63 at a rate required for combustion in proportion to increase or decrease in LPG, no probability with incomplete combustion will take place even in the presence of drops in output voltages of the batteries.

And, since the gas combustor section 73 includes the forward end face formed of the wire gauze 81 with more fine mesh than that of the side wall, combustion gas tends to be ejected mainly onto the peripheral area through the wire gauze 79 with the rough meshes formed around the side wall.

When this takes place, depression of the ignition piezoelectric element 51 causes the ignition plug 9 to generate a spark, resulting in ignition of mixed gas ejecting from the forward end surface of the gas combustor section 73 to allow mixed gas to combust in the gas combustor section 73. Then, this combustion flame is almost caused to be outwardly expanded in a circular configuration from the side wall of the gas combustor section 73 such that a length of the combustion flame remains in a value of approximately several millimeters from the gas combustor section 73, tending to cause the frame to be expanded like a petal from the gas combustor section 73 at the center of the combustor 11 toward the eight combustion chambers 85 extending in the radial direction in a thin and uniform manner.

Since the air flow passages 87 between the outer peripheral surfaces of the star protrusions of the combustor 11 and the inner peripheral surface of the casing 3 are so formed in a way to have increased surface areas, heat values of the above eight combustion chambers 85 are efficiently transferred to the air stream delivered from the blower 17 to provide an increased heat exchange rate with reduction in pressure loss.

Consequently, even if the cordless hair drier 1 of the present invention has a dimension with an inner diameter 37 mm and a length of 115 mm smaller than that of a bore size of a commercially available electric hair drier, combustion with a heat value of 390 kcal/H was safely succeeded. That is, since a hot blast temperature at the outlet 15 is of approximately 120 C. and the casing 3 serving as the hair drier body has a temperature of about 45 C. after LPG supply and the power switch 45 has been turned off, no probability for the temperature remaining at a high level even when the hair drier 1 is contained directly after the use thereof, and a safety was confirmed.

In addition, the hot blast can be adjusted to a temperature in a range from 80 C. to 150 C. using the gas control knob 41. Also, due to a capability of the hair drier 1 of the present invention using LPG as combustion gas, a large volume of warm steam is created through combustion of LPG without the use of water as required in a normal electric type hair drier, resulting in no damage caused in hairs with a favorable influence. In this connection, merely a dry air stream could be obtained in the electric type hair drier.

From the foregoing description, it appears that, due to the provision of the combustor 11 serving as the combustion cylinder formed with a plurality of combustion chambers 83 so as to increase the combustion surfaces areas as large as possible, the gas combustion type hair drier 1 of the present invention may have the combustion flame in a shortened length, the combustion flame can be trapped within a limited area of a combustion point of the combustor 11. Also, no heat accumulation occurs at the center of the combustor 11, an increased heat exchange rate can be obtained between the heat resulting from the combustion chambers and blast delivered from the blower 17. Since the combustor 11 is comprised of the plurality of narrow combustion chambers 83 to form the air flow passages 85 of increased volumes in the casing 3, the combustor 11 is able not to provide adverse affect on delivery of blast from the blower 17 to a level as less as possible, resulting in a capability of avoiding pressure loss.

Moreover, the present invention is not limited to particular embodiments described above and may be carried out in the other embodiments through appropriate modifications.

INDUSTRIAL APPLICABILITY

As will be understood from the foregoing description of the embodiments of the present invention, according to a first aspect of the gas combustion type hair drier of the present invention, since the ejector generates the negative pressure due to the ejector effect caused by the ejecting speed of combustion gas, air required for combustion can be automatically drawn in proportion to the increase and decrease of combustion gas. Accordingly, even if voltage drop occurs in the batteries with a resultant decrease in the flow rate of blast generated by the blower, incomplete combustion can be avoided.

In addition, according to the first aspect, since the combustion frame can be created like the petal extending from the gas combustor section at the center of the combustor toward the plural combustion chambers extending in the radial direction S in the thin and uniform manner, the heat values of the respective combustion chambers can be transferred to the air stream delivered from the blower in an efficient manner, resulting in an increased heat exchange rate.

Further, according to a second aspect of the gas combustion type hair drier of the present invention, due to the provision of the intake air stabilizer member, composed of porous raw material, which is disposed at the air intake portions of the ejector, it becomes possible to avoid the influence of an unstable condition of the air stream resulting from the blast delivered from the blower.

Additionally, according to the second aspect, by employing a metallic gauze, sintered metal, porous ceramic and porous plastic, which are low in cost and simple in structure, as porous raw material, it is possible to prevent a disturbance resulting from blast delivered from the blower through effective rectification of the air stream in the vicinity of the air intake ports.

And, according to a third aspect of the gas combustion type hair drier of the present invention, the presence of the air flow passages formed between the outer peripheral surface of the combustor and the inner peripheral surface of the casing allows the heat value of the combustor to be efficiently transferred to the air stream delivered form the blower through the outer peripheral surface of the combustor to increase the heat exchange rate, resulting in reduction in the pressure loss rate.

Moreover, according to a fourth aspect of the gas combustion type hair drier of the present invention, since the gas straight blow limiter segment is disposed at the combustion gas ejector portion of the combustor, combustion gas of the gas combustion section can be ejected mainly in the radial direction. Consequently, the combustion flame can be created in the thin and uniform manner in the radial direction, the flame can be prevented from occurring at the exhaust port of the combustor.

In addition, according to a fifth aspect of the gas combustion type hair drier of the present invention, the flame can be distinguished through the use of the combustion catalyst to be nonflammable, reliably protecting occurrence of the flame at the exhaust port of the combustor.

And, according to a sixth aspect of the gas combustion type hair drier of the present invention, an ability for LPG to combust followed by the formation of a large amount of warm steam enables the formation of hot blast with a large amount of steam without exerting damages to the hairs while providing a favorable influence.

Additionally, according to a seventh aspect of the gas combustion type hair drier of the present invention, it is possible to form mixed gas at a high purity.

What is claimed is:

1. A gas combustion type hair drier comprising:

a gas tank for storms combustion gas therein;

a cylindrical combustor provided with a gas combustor section for combusting combustion gas supplied from the gas tank;

a blower for exchanging heat resulting from the combustor;

a power supply for rotating a motor of the blower;

an igniter for igniting the combustion gas;

an ejector for drawing outside air resulting from negative pressure caused by a flow speed of combustion gas supplied to the combustor; and a casing in which the combustor, the blower and the ejector are accommodated;

wherein the combustor further has a plurality of combustion chambers composed of non-circular outer peripheral walls formed around a periphery of the gas combustor section, and wherein the outer peripheral walls have recessed configurations extending in radial directions.

2. The gas combustion type hair drier according to claim 1, wherein the ejector further has air intake portions around which an intake air stabilizing member is disposed so as to prevent an air stream from being influenced to fall in an unstable condition resulting from blast delivered from the blower to thereby achieve stabilization of intake air.

3. The gas combustion type hair drier according to claim 2, wherein the intake air stabilizing member is composed of porous raw material.

4. The gas combustion type hair drier according to claim 1, wherein the combustor is located between the blower and an outlet of the casing.

5. The gas combustion type hair drier according to claim 1, wherein an outer peripheral wall of the combustor has a portion to be partially held in contact with an inner wall of the casing.

6. The gas combustion type hair drier according to claim 1, further comprising:

air flow passage portions defined between an outer peripheral wall of the combustor and an inner peripheral wall of the casing.

7. The gas combustion type hair drier according to claim 1, wherein the gas combustor section further includes a gas straight blow limiter segment disposed at an ejecting portion of the combustion gas within the combustor to prevent the combustion gas from directly advancing while promoting to combustion gas to flow out in a radial direction.

8. The gas combustion type hair drier according to claim 1, wherein the combustor further includes an outlet portion in which a combustion catalyst is disposed.

9. The gas combustion type hair drier according to claim 1, wherein the gas combustion gas includes LPG.

10. The gas combustion type hair drier according to claim 1, wherein the ejector further includes the combustion gas storage chamber, a mixed gas generating chamber, and a filter disposed between the combustion gas storage chamber and the mixed gas generating chamber to remove impurities and dusts from the combustion gas.

* * * * *